United States Patent [19]

Milton et al.

[11] Patent Number: 4,518,097

[45] Date of Patent: May 21, 1985

[54] PLASTIC CONTAINER AND CLOSURE

[75] Inventors: James W. Milton, Short Hills; Robert W. Boig, Monroe Township, Middlesex County, both of N.J.

[73] Assignee: Van Dorn Co., Elizabeth, N.J.

[21] Appl. No.: 613,613

[22] Filed: May 24, 1984

[51] Int. Cl.[3] ..... B65D 39/00

[52] U.S. Cl. ..... 220/307; 220/306; 220/380; 206/508

[58] Field of Search ..... 220/306, 307, 72, 74, 220/355, 380; 150/55; 428/35; 206/508

[56] References Cited

U.S. PATENT DOCUMENTS

| | | | |
|---|---|---|---|
| 4,210,258 | 7/1980 | Von Holdt | 220/306 |
| 4,293,080 | 10/1981 | Letica | 220/307 |
| 4,308,970 | 1/1982 | Von Holdt | 220/306 |
| 4,349,119 | 9/1982 | Letica | 220/307 |
| 4,429,805 | 2/1984 | Letica | 220/306 |

*Primary Examiner*—George T. Hall

*Attorney, Agent, or Firm*—Kenyon & Kenyon

[57] ABSTRACT

A container assembly having a cylindrical container body and a substantially circular container lid is provided with inwardly extending annular reinforcing ribs on an inner surface of the container body in the region of the mouth thereof and with angularly equispaced radially extending reinforcing ribs on the container lid extending from a V-shaped annular channel at the periphery of the lid substantially to an indented circular area at the center thereof. Closure of the lid to the body is effectuated by means of a pair of longitudinally spaced annular shoulders on an inside surface of the container body and a pair of complementary annular lips on the container lid, as well as a third annular shoulder on an outside surface of the container body and a corresponding annular lip on the container lid. One of the inner shoulder surfaces on the container body is disposed in substantially the same transverse plane as the annular shoulder located on the outer surface of the container body.

20 Claims, 6 Drawing Figures

PLASTIC CONTAINER AND CLOSURE

BACKGROUND OF THE INVENTION

This invention relates to a plastic container and, more particularly, to a container including cylindrical container receptacle, a circular container lid and to closure elements at the rim of the container receptacle and at the periphery of the container lid for locking the lid to the receptacle in a fluid-tight fit.

Many proposals have been disclosed and utilized for effectuating a fluid-tight seal between a circular container lid and a cylindrical container body. U.S. Pat. No. 4,293,080 to Letica, for example, discloses a resealable, cylindrical plastic container assembly with a rim and lid interlock structure which provides an efficacious rim-to-lid seal. The rim of the container body or receptacle is formed with a cross-sectionally semi-circular annular bead, while the lid is provided at its periphery with a cross-sectionally circular groove for conformingly engaging the rim bead upon a snap-lock fit of the lid to the container receptacle. On its inner side, the generally cylindrical wall of the receptacle or container body is formed with a single annular shoulder in the form of a rounded edge which is conformingly engaged by a corresponding lip on the container lid in a closed state of the container assembly.

U.S Pat. No. 4,293,080 further discloses a plurality of outwardly extending annular reinforcing ribs disposed on an outer side of the cylindrical wall of the receptacle in a region about the rim of the receptacle or container body. In the region of the reinforcing ribs the container wall is formed with an annular indentation whereby the reinforcing ribs do not project substantially beyond the outer surface of the cylindrical container wall. The container wall is further provided with a plurality of circumferentially equispaced longitudinal reinforcing ribs disposed in the indentation of the cylindrical container wall, each longitudinal rib being contiguous with each of the annular reinforcing ribs.

Various means have also been suggested and utilized for strengthening plastic container lids. U.S. Pat. No. 4,210,258 to von Holdt for example, discloses a circular plastic container lid provided at its periphery with a substantially V-shaped annular channel portion provided in a channel or groove with a multiplicity of angularly equispaced radially extending reinforcing fins. That patent also discloses a plurality of circular wave-shaped corrugations at the center of the container lid. U.S. Pat. No. 4,117,950 to Allen shows a cross-sectionally arcuate container lid provided on an inside surface with a multiplicity of angularly equispaced reinforcing ribs extending from the periphery of the lid to substantially the center thereof. The ribs are in the form of elongate ridges.

An object of the present invention is to provide a plastic container assembly of the above-described type with improved closure elements for enhancing the locking of the container lid to the container body and for increasing the effectiveness of the container seal.

Another object of the present invention is to provide a container receptacle body of the above-mentioned type with an improved reinforcing structure at the mouth of the container body.

Yet another object of the present invention is to provide a plastic container lid of the above-mentioned type with an improved reinforcing structure for enhancing the strength of the container lid while preserving the flexibility needed for resealing and reopening the container.

SUMMARY OF THE INVENTION

In accordance with the present invention a plastic container comprises a container body, a substantially planar container lid and detent means for locking the lid to the container body. The container body has a cylindrical wall with an inner side and an outer side and with a longitudinal axis of symmetry. At one end the cylindrical wall is formed with a circular rim defining a container mouth. At an end of the cylindrical wall opposite the circular rim, the container body is provided with a planar wall. The container lid is substantially planar and has a circular periphery with closure elements engageable with the rim of the container body in a snap-lock fit for closing the container. The detent means includes first, second and third shoulder surfaces on the cylindrical wall of the container body and first, second and third lips on the container lid, the lips conformingly engaging respective shoulder surfaces in a closed state of the container. The first shoulder surface is disposed on the outer side of the cylindrical container wall in a region about the rim, while the second and the third shoulder surfaces are disposed on an inner side of the cylindrical wall in a region about the container rim, the third shoulder surface being located between the container rim and the second shoulder surface. The second shoulder surface and the third shoulder surface face inwardly into the container body substantially towards the closed end thereof.

In accordance with particular features of the present invention, the first shoulder surface and the third shoulder surface are disposed in substantially the same transverse plane perpendicularly to the axis of symmetry of the container body, while the container wall is provided with a rim bead having a substantially rectangular cross-section, the sides of the bead being defined in part by the first and third annular shoulder surfaces.

Thus, in accordance with the present invention, the locking of the container lid to the container body is effectuated in part by means of a pair of inwardly facing shoulders longitudinally spaced from one another along the inner side of the container body in a region about the container rim. These shoulder surfaces cooperate with corresponding locking members in the form of lips or shoulders on the container lid. The locking function is considerably enhanced by this provision on the inside of the container of two pairs of interlocking latch elements on the container body and the container lid. The efficacy of the locking mechanism is further augmented by the disposition of one of the inner shoulder surfaces at substantially the same height or longitudinal position as the outer locking shoulder and by the substantially rectangular cross-section design of the bead at the rim of the container body.

It is further provided in accordance with the present invention that the container lid conformingly engages the cylindrical wall of the container body in the regions of the shoulder surfaces, thereby promoting the fluid-tight seal between the lid and the container body. The lid is advantageously formed at its periphery with an annular groove having the same cross-section and dimensions as the bead at the rim of the container body, whereby the lid groove conformingly engages the bead in a closed state of the container assembly.

Pursuant to another aspect of the present invention, the cylindrical wall of the container body is provided on its inner side with at least one inwardly extending annular reinforcing rib in a region about the container rim. In addition, the cylindrical wall of the container body is advantageously formed at the container mouth with a cross-sectionally L-shaped annular portion. The L-shaped portion includes an inwardly and transversely extending annular flange and, at an inner end of the annular flange, a longitudinal cylindrical flange extending on a side of the annular flange opposite the planar wall of the container body, the cylindrical flange terminating with the rim bead. The annular reinforcing rib is disposed on a side of the annular flange opposite the cylindrical flange and is spaced from the annular flange, thereby forming therewith an annular trough or groove. The cylindrical wall may be provided in the region of the L-shaped portion with a plurality of longitudinally spaced inwardly extending annular reinforcing ribs, whereby a plurality of annular troughs or grooves is formed with the L-shaped member at the mouth of the container body.

A container assembly having annular reinforcing ribs disposed on the inner side of the cylindrical container wall in the region of the container mouth exhibits at least two advantages over container assemblies manufactured in accordance with prior art teachings. First the outer surface of the cylindrical wall remains perfectly smooth, there being no need to form an indentation or recess or to inwardly stagger a circular portion of the container wall in order to accommodate outwardly extending reinforcing ribs or fins. Second, inwardly extending annular reinforcing ribs serve an auxiliary function of providing a convenient means for wiping excess paint from a paint brush, in the event that the container is used to hold paint.

Pursuant to a further aspect of the present invention, the lid has an annular planar portion disposed in a first plane. The lid is provided at its center with a circular area or portion contiguous with the annular planar portion and laterally shifted with respect thereto, whereby the circular area is disposed in a second plane parallel to and spaced from the first plane. The lid is formed at its periphery with a cross-sectionally V-shaped annular channel portion having an oblique annular outer flange and an oblique inner flange, the lid being provided on the same side of the first plane as the circular area with a plurality of annularly equispaced reinforcing ribs having first edges connected to the inner flange and second edges connected to the annular planar portion of the lid. The reinforcing ribs extend from the periphery of the lid substantially to the circular area at the center of the lid. The reinforcing ribs on the lid are advantageously triangular, but may take the form of quadrilaterals each having a third edge contiguous with and joined to an annular wall sebtion connecting the annular planar portion of the lid to the circular area or portion thereof.

A container lid of a plastic container assembly in accordance with the present invention is particularly strong and capable of withstanding substantial forces directed transversely to the body of the lid.

DETAILED DESCRIPTION OF THE INVENTION

Figure 1:
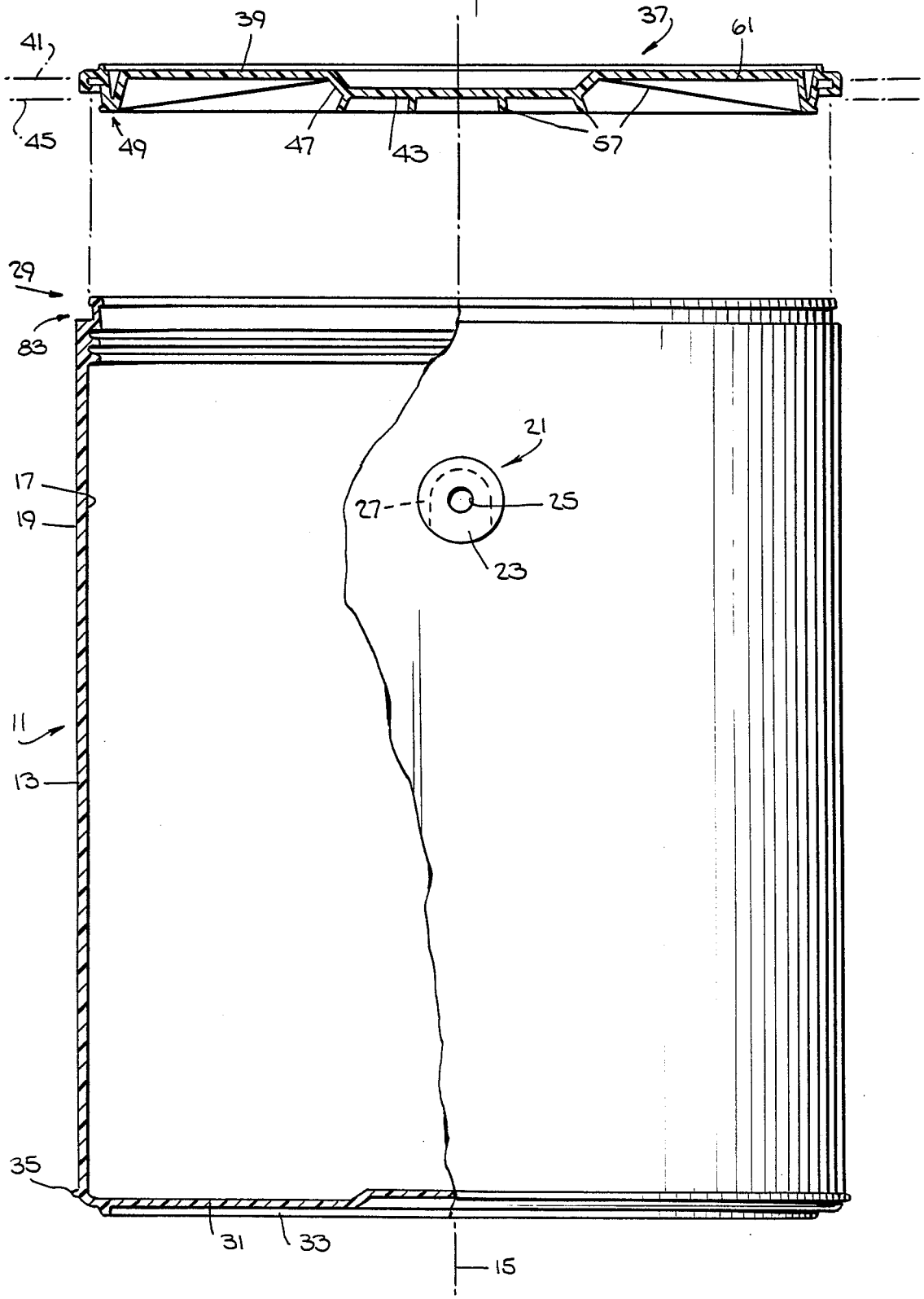
FIG. 1 is an exploded view, partially in cross-section, of a container assembly in accordance with the present invention, showing a container lid and a container body.

As illustrated in FIG. 1, a container assembly in accordance with the present invention comprises a container body or receptacle 11 having a cylindrical outer wall 13 with a longitudinal axis of symmetry 15 and an inner surface or side 17 and an outer surface or side 19. Container body 11 is provided on the outside surface 19 with a pair of ears 21 each including a circular plate 23 pierced with a hole 25 and connected to outer surface 19 by means of a U-shaped flange 27.

At one end, cylindrical wall 13 is provided with a circular rim 29 which defines a circular mouth of container body 11. At an opposite end of cylindrical wall 13, container body 11 is provided with a generally planar wall 31 forming the bottom of the receptacle.

Figure 4:
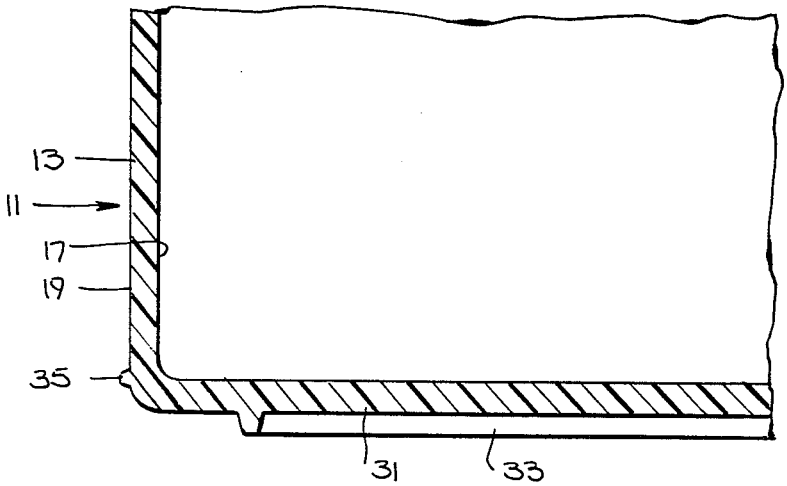
FIG. 4 is a partial cross-section view of the container body of FIGS. 1–3.
Figure 3:
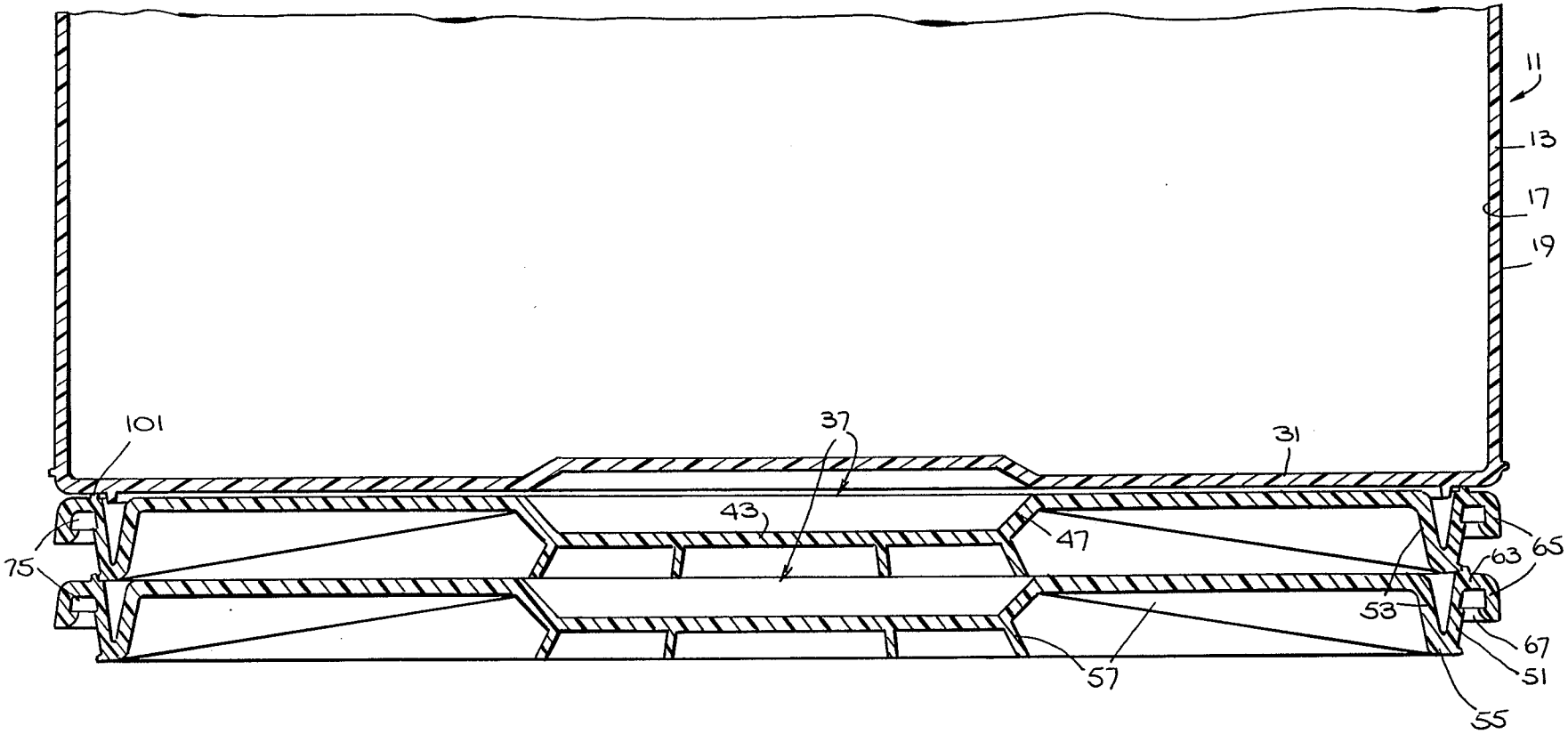
FIG. 3 is a partial cross-section view showing a pair of container lids and a container body stacked on top of one another.

As illustrated in FIGS. 1 and 4, a longitudinally extending annular ridge 33 is provided on the outside surface of planar wall 31. This ridge facilitates the stacking of plastic containers according to the present invention, as illustrated in FIG. 3. Container body 11 is further provided with an outwardly extending annular ridge 35 on the outer side 19 of cylindrical wall 13 in the region of planar wall 31. Ridge 35 serves to control the spacing between adjacent plastic containers according to the present invention when the containers are arranged in a horizontal array.

Figure 2:
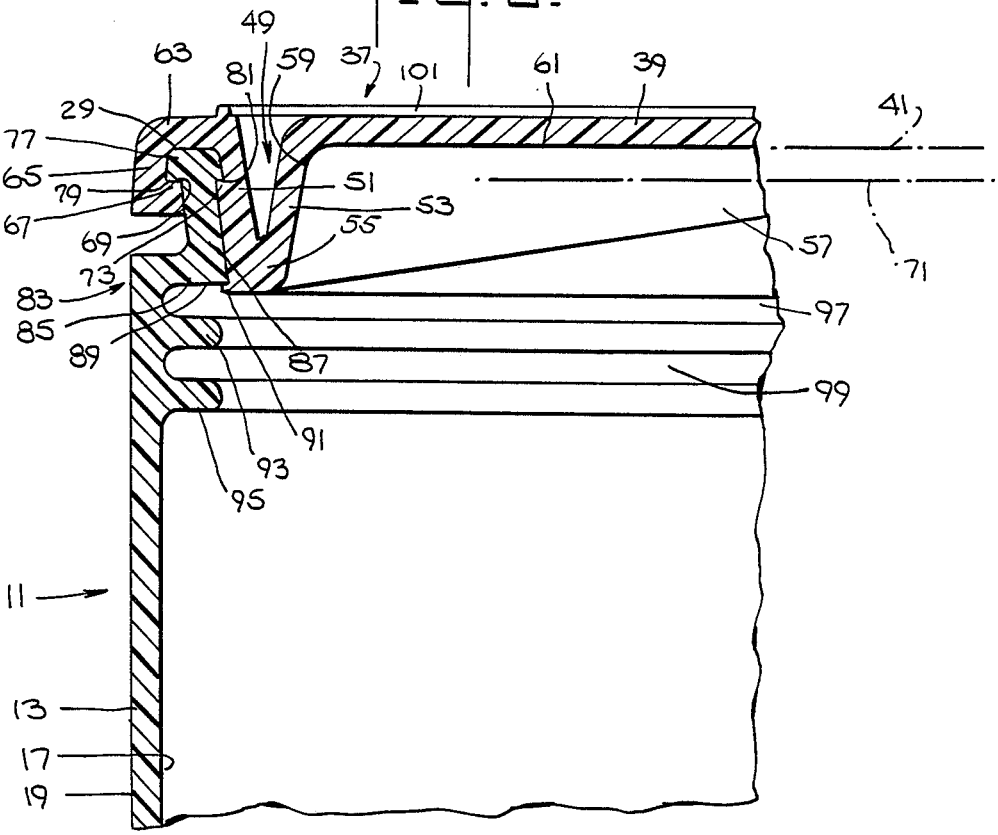
FIG. 2 is a partial cross-section view of the container assembly of FIG. 1, showing the container lid locked to the container body in a closed state of the container assembly.

As shown in FIGS. 1, 2 and 3, the container assembly includes a substantially circular container lid 37 comprising an annular planar body portion 39 disposed in a plane 41 oriented transversely or perpendicularly to axis of symmetry 15 in a closed state of the container assembly. Container lid 37 further comprises a centrally located circular area or portion 43 laterally staggered with respect to annular portion 39. Circular area 43 is disposed in a plane 45 parallel to plane 39 and spaced therefrom on a side of the annular body portion 39 of lid 37 which faces into receptacle or container body 11 in a closed state of the container assembly. Circular area 43 is connected to annular body portion 39 by means of an oblique annular wall section 47.

Lid 37 is formed at its periphery with a cross-sectionally V-shaped channel portion 49 disposed on the same side of plane 41 as circular lid portion 43. V-shaped channel portion 49 includes an oblique or inclined annular outer flange 51 and an oppositely inclined annular inner flange 53, these flanges being joined to one another at a circular bight 55. Lid 37 is provided with a multiplicity of angularly equispaced, triangularly shaped reinforcing ribs or fins 57 each having a first edge 59 joined to inner flange 53 and a second edge 61 joined to annular lid portion 39. Ribs 59 extend from V-shaped channel 49 at the periphery of lid 37 substantially to circular area 43 at the center thereof.

As illustrated in FIG. 2, lid 37 is provided at its periphery with an annular flange 63 extending parallel to plane 41 and transversely to axis 15 in a closed state of the container assembly. Flange 63 is integral at its inner end with outer flange 51 and joined at its outer end to a longitudinally extending substantially cylindrical flange 65. Cylindrical flange 65 is formed at an end opposite annular flange 63 with an inwardly extending ridge or lip 67 having an annular planar surface 69 located in a plane 71 oriented parallel to plane 41 and spaced therefrom.

Outer channel flange 51 is formed on an outer surface with a lip or ledge 73 having an annular lip surface disposed in plane 71 radially inwardly from lip surface 69. Outer channel flange 51, flange 63, cylindrical flange 65 and lips 67 and 73 together define a cross-sectionally rectangular annular groove or channel 75 at the outer periphery of lid 37

Groove 75 has substantially the same cross-section and dimensions as a cross-sectionally rectangular annular bead 77 formed at the rim of container body 11. Bead 77 is defined in part by a pair of annular shoulder surfaces 79 and 81. Shoulder surface 79 is located on the outer side 19 of cylindrical wall 13, while annular shoulder 81 is disposed on the inner side 17 of the cylindrical wall. Annular shoulder surface 81 faces into container body 19 towards planar end wall 31.

In the region of the mouth of container body 11 cylindrical wall 13 is formed with an annular substantially L-shaped portion 83 which comprises an inwardly extending annular flange 85 and a longitudinally extending substantially cylindrical flange 87. Cylindrical flange 87 is connected to an inner end of inwardly extending annular flange 85 and is disposed on a side thereof opposite the planar wall 31 of container body 11. At an end opposite annular flange 85, cylindrical flange 87 is formed with rim bead 77.

Inwardly extending annular flange 85 has an annular surface 89 extending transversely to axis 15 on a side of flange 85 opposite cylindrical flange 87, which annular surface serves as a shoulder which cooperates or co-functions with a lip or ridge 91 formed on outer channel flange 51 at an end thereof opposite annular flange 63. Annular ridge 91 and shoulder surface 89 co-function to lock lid 37 to container body 11 at the rim 29 thereof upon a closing of the container assembly in a snap-lock fit assembly step.

During a closure of a container assembly in accordance with the present invention, lip or ridge 67 is forced over bead 77, cylindrical flange 65 being bent resiliently outwardly. Upon the completion of the closure operation, cylindrical flange 65 snaps inwardly towards bead 77 and the wall surfaces of channel or groove 75, including the surfaces of lips 67 and 73, come into conforming engagement with the outer surfaces of rim bead 77. Similarly, the outer surface of outer flange 51 conformingly engages the inner surface of cylindrical flange 87, while cylindrical ridge 91 conformingly engages shoulder surface 89 of annular flange 85.

As illustrated in FIG. 2, cylindrical wall 13 of container body 11 is provided on its inside surface 17 with a pair of inwardly extending annular ribs or fins 93 and 95. Ribs 93 and 95 are longitudinally spaced from one another and from the lower shoulder surface 89 of annular flange 85 to form a pair of longitudinally spaced annular troughs or grooves 97 and 99. Troughs or grooves 97 and 99 have approximately the same thickness as the annular reinforcing ribs 93 and 95. Ribs 93 and 95 have a width, i.e., a radial dimension, approximately equal to the width or radial dimension of annular flange 85.

As illustrated in FIG. 2, lid 37 is advantageously provided on a side opposite V-shaped channel 49 and circular area 43 with a longitudinally extending annular ridge 101 at the inner end of annular flange 63. As shown in FIG. 3, ridge 101 facilitates the stacking of closed container assemblies in accordance with the present invention, ridge 101 of one container assembly contacting the outer surface of planar wall 31 of an overlying container assembly.

FIG. 3 also illustrates the manner in which two or more lids 37 may be stacked on top of one another Ridge or lip 91 (see FIG. 2) of one container lid 37 engages an upper surface of an underlying container lid in an annular region immediately to the inside of ridge 101.

Figure 5:
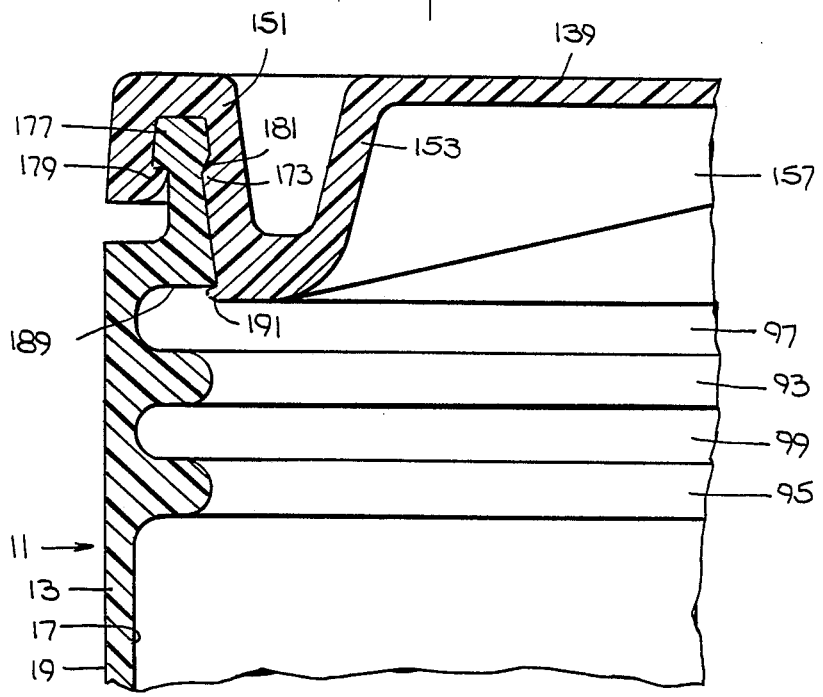
FIG. 5 is a partial cross-section view of a container lid locked to a container body, showing modified locking elements in accordance with the present invention.
Figure 6:
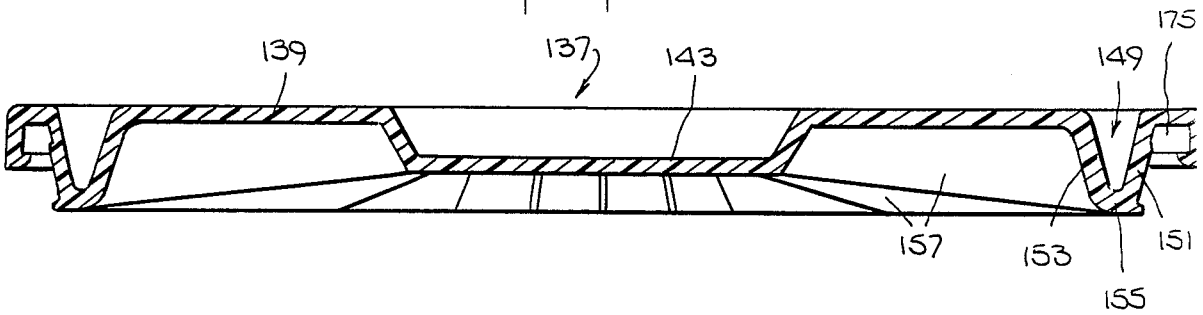
FIG. 6 is a cross-section view of a container lid with modified reinforcing features in accordance with the present invention.

As illustrated in FIGS. 5 and 6, a container lid 137 in accordance with the present invention may be provided with a multiplicity of angularly equispaced radially extending reinforcing ribs or fins 157 which have a quadrilateral shape. Lid 137 is formed at its periphery with a cross sectionally V-shaped channel 149 having an oblique annular outer flange 151, an oppositely inclined annular inner flange 153 and a circular bight 155 connecting the two flanges. Inner flange 153 is connected at an end opposite bight 155 to an annular planar lid portion 139 in turn connected along a circular inner edge to a circular planar portion 143 by means of an oblique wall section 147. Each quadrilateral fin 157 has a first edge connected to inner flange 153, a second edge connected to annular planar portion 139 and a third edge connected to annular wall section 147. The edges of quadrilateral fins 157 connected to inner flange 153 and to wall section 147 are substantially width-wise coextensive therewith.

As illustrated in FIG. 5, outer flange 151 is provided on an outer side with a pair of longitudinally spaced annular lips or ledges 173 and 191 for conformingly engaging complementary annular shoulder surfaces 181 and 189 formed on an annular L-shaped section 183 of cylindrical wall 13. Shoulder surface 181 is located substantially radially inwardly from a transversely extending annular shoulder surface 179 located on the outer side of the cylindrical container wall 13 in the region of the rim thereof. Shoulder surface 179 and 181 form sides of a partially rectangularly shaped rim bead 177 formed at the outer end of L-shaped portion 183. In a closed state of the container body and lid shown in FIG. 5, bead 177 conformingly engages a groove or channel 175 at the outer periphery of lid 137, as generally described heretofore with respect to FIG. 2.

What is claimed is:

1. A plastic container comprising:

a container body having a cylindrical wall with a longitudinal axis of symmetry, said cylindrical wall having at one end a circular rim defining a container mouth, said container body having a planar wall at an end of said cylindrical wall opposite said rim and said mouth, said cylindrical wall having an inner side and an outer side;

a substantially planar container lid having a circular periphery with closure means engageable with said rim in a snap-lock fit for closing said container; and detent means for locking said lid to said container body upon the engagement of said closure means with said rim during a closing operation, said detent means including:

(a) at least one first shoulder surface on said outer side of said cylindrical wall in a region about said rim and a first lip on said lid conformingly engaging said first shoulder surface in a closed state of said container;

(b) at least one second shoulder surface disposed on said inner side of said cylindrical wall in a region about said rim and a second lip on said lid conformingly engaging said second shoulder surface in a closed state of said container, said second shoulder surface facing inwardly into said body substantially towards the closed end thereof; and (c) at least one third shoulder surface disposed on said inner side of said cylindrical wall between said rim and said second shoulder surface and a third lip on said lid conformingly engaging said third shoulder surface in a closed state of said container, said third shoulder surface facing inwardly into said body substantially towards the closed end thereof.

2. The plastic container defined in claim 1 wherein said first shoulder surface is one annular surface oriented substantially perpendicularly to said axis of symmetry, and wherein said third shoulder surface is another annular surface having approximately the same longitudinal position along said cylindrical wall as said one annular surface.

3. The plastic container body defined in claim 2 where said other annular surface is oriented substantially perpendicularly to said axis of symmetry and lies in the substantially same transverse plane as said one annular surface.

4. The plastic container defined in claim 3 wherein said container wall is provided with a rim bead having a substantially rectangular cross section, said rim bead having sides defined in part by said one annular surface and said other annular surface.

5. The plastic container defined in claim 4 wherein said lid is formed at said periphery with an annular groove having a cross-sectionally rectangular portion of substantially the same dimensions as said bead, said rectangular portion of said groove conformingly engaging said bead in a closed state of said container.

6. The plastic container defined in claim 5 wherein said cylindrical wall is formed at said mouth with a cross-sectionally L-shaped annular portion including an inwardly and transversely extending annular flange and, at an inner end of said annular flange, a longitudinal cylindrical flange extending away from said planar wall and terminating with said bead, said second annular surface being defined in part by an inner circular edge of said L-shaped annular portion and being disposed on a side of said annular flange opposite said cylindrical flange.

7. The plastic container defined in claim 6 wherein said cylindrical wall is provided on said inner side with at least one inwardly extending annular reinforcing rib in a region about said L-shaped annular portion.

8. The plastic container defined in claim 7 wherein said cylindrical wall is provided with a plurality of longitudinally spaced inwardly extending annular reinforcing ribs in a region about said L-shaped annular portion, said ribs forming with said annular flange a plurality of annular troughs at said mouth.

9. The plastic container defined in claim 6 wherein said lid is formed at said periphery with a cross-sectionally V-shaped annular portion having an oblique annular outer flange defining in part said annular groove and bearing at an end opposite said groove an outwardly extending ridge forming said second lip, said outer flange conformingly engaging said cylindrical flange in a closed state of said container.

10. The plastic container defined in claim 9 wherein said V-shaped annular portion includes an oblique annular inner flange, said lid being provided, on a side facing into said body in a closed state of said container, with a plurality angularly equispaced reinforcing ribs having first edges connected to said inner flange and second edges joined to said lid on the side thereof facing into said body in a closed state of the container.

11. The plastic container defined in claim 10 wherein said lid has a substantially flat body portion disposed in a first plane oriented perpendicularly to said axis of symmetry in a closed state of said container, said lid being provided at its center with a circular area contiguous with said major body portion and laterally shifted with respect thereto, said circular area being disposed in a second plane parallel to and spaced from said first plane and on the same side of said major body portion as said reinforcing ribs.

12. The plastic container defined in claim 11 wherein said reinforcing ribs are triangular and extend radially from said V-shaped annular portion inwardly substantially to said circular area.

13. The plastic container defined in claim 11 wherein said lid includes an annular wall section connecting said major body portion to said circular area, said reinforcing ribs each having a third edge connected to said annular wall section.

14. A plastic container lid comprising:

a substantiallly flat annular body portion disposed in a first plane;

a substantially flat centrally located circular portion contiguous with said annular body portion and disposed in a second plane parallel to and spaced from said first plane;

closure means at an outer edge of said annular body portion for cooperating with the rim of a cylindrical receptacle to lock the lid to the receptacle and to provide a fluid tight seal, said closure means including a substantially V-shaped annular channel portion having an oblique annular outer flange and an oblique annular inner flange connected thereto, said channel portion being disposed on the same side of said first plane as said circular portion; and a plurality of angularly equispaced reinforcing ribs having first edges connected to said inner flange and second edges connected to said annular body portion, said ribs extending radially inwardly substantially to said circular portion.

15. The plastic container lid defined in claim 14 further comprising an annular wall section connecting said annular body portion to said circular portion, said reinforcing ribs each having a third edge connected to said annular wall section.

16. The plastic container lid defined in claim 14 wherein said reinforcing ribs are triangular.

17. The plastic container lid defined in claim 14 wherein said first edges of said ribs have a common length substantially equal to the width of said inner flange.

18. A plastic container body comprising:

a cylindrical wall having a rim at one end defining a circular container mouth, said cylindrical wall having an inner side and an outer side;

a planar wall contiguous with said cylindrical wall at an end thereof opposite said rim;

closure means at said rim for cooperating with a securing element on a container lid to lock the lid to the container body in a fluid-tight sealing engagement; and at least one inwardly extending annular reinforcing rib disposed on said inner side of said cylindrical wall proximately to said rim.

19. The plastic container body defined in claim 18 wherein said cylindrical wall is formed at said mouth with an annular cross-sectionally L-shaped portion including an inwardly and transversely extending annular flange and, at an inner end of said annular flange, a longitudinal cylindrical flange extending in a direction away from said planar wall, said reinforcing rib being disposed on a side of said annular flange opposite said cylindrical flange and spaced from said annular flange to form an annular trough.

20. The plastic container body defined in claim 19, further comprising a plurality of laterally spaced inwardly extending reinforcing ribs.

* * * * *

UNITED STATES PATENT AND TRADEMARK OFFICE

CERTIFICATE OF CORRECTION

PATENT NO. : 4,518,097

DATED : May 21, 1985

INVENTOR(S) : James W. Milton and Robert W. Boig

It is certified that error appears in the above-identified patent and that said Letters Patent is hereby corrected as shown below:

Column 3, line 56 change "sebtion" to - section -

Column 6, line 14 change "another" to - another.-

Column 8, line 10 change "plurality" to - plurality of -

Signed and Sealed this

*Nineteenth* Day of *November 1985*

[SEAL]

*Attest:*

DONALD J. QUIGG

*Attesting Officer*

*Commissioner of Patents and Trademarks*